US011284726B1

(12) United States Patent
Ulrich et al.

(10) Patent No.: US 11,284,726 B1
(45) Date of Patent: Mar. 29, 2022

(54) BARRIER FOR MATTRESS AND BED DECK

(71) Applicant: Trinity Guardion, LLC, Batesville, IN (US)

(72) Inventors: David John Ulrich, Sunman, IN (US); Bruce M. Rippe, Batesville, IN (US)

(73) Assignee: Trinity Guardion, Inc., Batesville, IN (US)

( * ) Notice: Subject to any disclaimer, the term of this patent is extended or adjusted under 35 U.S.C. 154(b) by 37 days.

(21) Appl. No.: 16/811,095

(22) Filed: Mar. 6, 2020

Related U.S. Application Data

(60) Provisional application No. 62/815,662, filed on Mar. 8, 2019.

(51) Int. Cl.

| | |
|---|---|
| ***A47C 31/10*** | (2006.01) |
| ***A47C 27/00*** | (2006.01) |
| ***A47C 21/02*** | (2006.01) |
| ***A47G 9/04*** | (2006.01) |

(52) U.S. Cl.
CPC ..... *A47C 31/105* (2013.01); *A47C 21/022* (2013.01); *A47C 27/008* (2013.01); *A47G 9/04* (2013.01)

(58) Field of Classification Search
CPC ..... A47G 9/0292; A47G 9/0284; A47G 9/04; A47C 31/105; A47C 31/02; A47C 31/023; A47C 31/026; A47C 21/026; A47C 21/024; A47C 27/001; A47C 21/022; A47C 27/008
See application file for complete search history.

(56) References Cited

U.S. PATENT DOCUMENTS

| | | | | |
|---|---|---|---|---|
| 206,980 A * | 8/1878 | Squires | ..... | A47C 21/026 5/411 |
| 892,047 A * | 6/1908 | Halterman | ..... | A47G 9/04 128/872 |
| 1,137,220 A * | 4/1915 | Lehmann | ..... | A47C 23/02 5/242 |

(Continued)

FOREIGN PATENT DOCUMENTS

| | | |
|---|---|---|
| FR | 1112549 | 3/1956 |
| GB | 1193872 | 6/1970 |
| WO | 2012096640 A1 | 7/2012 |

OTHER PUBLICATIONS

Amazon, "Bulk Adhesive Button Assortment", Sep. 10, 2014 (see reviews), Fun Express Store, https://www.amazon.com/Awesome-Self-adhesive-Plastic-Buttons-Approx/dp/B005DS81HS#customerReviews.*

(Continued)

*Primary Examiner* — Peter M. Cuomo
*Assistant Examiner* — Morgan J McClure
(74) *Attorney, Agent, or Firm* — Ulmer & Berne LLP

(57) ABSTRACT

A barrier for a mattress and a bed deck is provided. The barrier includes a mattress cover portion and a skirt. The mattress cover portion is configured to fit over a top and sides of a mattress. The skirt extends beneath the mattress cover portion. The skirt comprises an upper panel and a lower panel. The upper panel is coupled with the mattress cover portion along a first perimeter. The lower panel is coupled with the upper panel along a second perimeter. The lower panel comprises a lower edge that defines a third perimeter. The lower panel is configured for selective coupling to a bed deck.

21 Claims, 9 Drawing Sheets

(56) References Cited

U.S. PATENT DOCUMENTS 2,024,050 A * 12/1935 May ..... A47C 21/022 24/72.5
2,037,216 A * 4/1936 Echlia ..... A47G 9/083 5/494
2,103,244 A * 12/1937 Briscoe ..... A47C 31/105 24/72.5
2,210,210 A * 8/1940 Kisilew ..... A47C 31/105 5/501
2,497,186 A * 2/1950 Pedersen ..... A47C 21/022 5/498
2,619,658 A * 12/1952 Weinberg ..... A47G 9/0292 5/493
2,641,001 A * 6/1953 Krasnov ..... A47G 9/0284 5/499
2,729,831 A * 1/1956 Fredfuld ..... A47G 9/04 5/494
2,763,875 A * 9/1956 Piontkowski ..... A47G 9/0284 5/493
2,791,784 A 5/1957 Tomsic
2,860,352 A * 11/1958 Gerald ..... A47C 21/022 5/498
2,995,762 A * 8/1961 Albinson ..... A47C 31/02 5/411
3,083,378 A * 4/1963 Pursell ..... A47G 9/0238 5/498
3,521,308 A * 7/1970 Fowler ..... A47C 21/026 5/498
3,530,487 A * 9/1970 Beer ..... A47G 9/02 5/496
3,837,020 A * 9/1974 Bosch ..... A47C 27/15 5/411
4,214,328 A * 7/1980 Custer, Jr ..... A47G 9/04 5/424
4,297,754 A * 11/1981 Zuniga ..... A47C 21/026 5/411
4,336,621 A * 6/1982 Schwartz ..... A47C 27/001 5/411
4,389,744 A * 6/1983 Monroe ..... A47G 9/02 5/496
4,402,098 A * 9/1983 McClam ..... A47G 9/0284 5/494
4,653,131 A * 3/1987 Diehl ..... A47C 21/08 128/872
4,660,240 A * 4/1987 Hutton ..... A47C 21/022 24/300
4,662,016 A * 5/1987 Seeman ..... A47C 21/022 24/72.5
4,703,529 A * 11/1987 Mann ..... A47G 9/0284 5/494
4,734,947 A * 4/1988 Vitale ..... A47G 9/0253 5/493
4,897,891 A * 2/1990 Kallman ..... A47G 9/0284 24/72.5
5,027,456 A * 7/1991 Wadsworth ..... A61F 5/3776 5/424
5,046,207 A 9/1991 Chamberlain
5,092,010 A * 3/1992 Wong ..... A47G 9/0284 5/493
5,099,531 A * 3/1992 Schmier ..... A47G 9/02 5/692
5,205,003 A * 4/1993 Green ..... A47G 9/0292 5/493
5,280,657 A * 1/1994 Stagg ..... A47G 9/04 5/496
5,335,383 A * 8/1994 Schwind ..... A47G 9/0284 5/482
5,353,456 A * 10/1994 Evans ..... A47G 9/0292 5/482
5,428,852 A * 7/1995 Tenuta ..... A47C 31/105 5/690
5,483,712 A * 1/1996 Greenwood ..... A47G 9/0292 24/72.5
5,638,562 A * 6/1997 Masoncup ..... A47G 9/0292 5/493
5,704,082 A * 1/1998 Smith ..... A47C 21/022 24/710.5
5,715,553 A * 2/1998 Baron ..... A47G 9/0284 5/493
5,733,397 A * 3/1998 McDaniel ..... A47G 9/0292 156/66
5,749,110 A * 5/1998 Gamble ..... A47G 9/0292 5/493
5,802,637 A * 9/1998 Bordo ..... A47C 31/11 297/219.11
5,911,654 A * 6/1999 Webb ..... A61G 7/0506 5/424
5,946,751 A * 9/1999 DeMay ..... A47G 9/0292 5/504.1
6,016,582 A * 1/2000 Larson ..... A47C 27/083 5/691
6,035,469 A * 3/2000 Schrougham ..... A47G 9/0292 5/493
6,044,503 A * 4/2000 McClendon ..... A47G 9/02 5/482
6,088,858 A * 7/2000 Juster ..... A47C 21/022 5/496
6,119,290 A * 9/2000 Masoncup ..... A47G 9/0292 5/482
6,185,766 B1 * 2/2001 Farrugia ..... A47C 21/022 24/72.5
6,233,764 B1 * 5/2001 Orr ..... A47C 21/022 5/496
6,502,255 B1 * 1/2003 Perkins ..... A47C 19/20 5/488
6,631,529 B1 * 10/2003 Erickson ..... A47G 9/0246 5/484
6,687,935 B2 * 2/2004 Reeder ..... A61G 7/05776 5/691
6,883,192 B1 * 4/2005 Rose ..... A47G 9/0292 24/72.5
6,987,075 B2 1/2006 Orlandi
7,039,310 B2 5/2006 Haraguchi et al.
7,093,310 B2 * 8/2006 Barros ..... A47G 9/0246 5/482
7,120,952 B1 10/2006 Bass et al.
7,325,263 B2 2/2008 Stribling
7,353,550 B2 * 4/2008 Antinori ..... A47C 21/026 5/411
7,380,297 B2 6/2008 Bauer
7,559,290 B2 * 7/2009 West ..... A01K 1/0353 119/28.5
7,754,625 B2 7/2010 Hendriks et al.
7,788,747 B2 9/2010 Kramer et al.
7,930,779 B2 4/2011 Marrache
7,971,289 B2 7/2011 Payne et al.
8,087,109 B2 1/2012 Hillenbrand, II
8,671,478 B2 * 3/2014 Rippe ..... A47C 21/022 5/498
8,683,627 B2 * 4/2014 Rippe ..... A47C 31/007 5/497
9,049,941 B2 * 6/2015 Clenet ..... A47C 21/022
9,089,224 B1 * 7/2015 Baker ..... A47C 31/02
9,549,625 B1 * 1/2017 Wilkinson ..... A47G 9/0223
9,924,813 B1 * 3/2018 Basten ..... A47G 9/02
10,368,654 B2 * 8/2019 Sopher ..... A47C 21/028
10,736,434 B1 * 8/2020 Kinion ..... A47G 9/0246
2004/0060113 A1 * 4/2004 Lantagne ..... A47C 21/022 5/494
2004/0154102 A1 * 8/2004 Cohen ..... A47G 9/0292 5/493
2004/0231053 A1 * 11/2004 Masoncup ..... A47G 9/0292 5/493
2004/0237197 A1 * 12/2004 Cohen ..... A47G 9/0292 5/493
2005/0086740 A1 * 4/2005 Babjak ..... A47G 9/0292 5/493
2006/0000020 A1 * 1/2006 Matheus ..... A47C 27/081 5/110

(56) References Cited

U.S. PATENT DOCUMENTS

2007/0000053 A1* 1/2007 Yang ..... A47G 9/02 5/493
2007/0017028 A1* 1/2007 Myers ..... A47G 9/0246 5/497
2007/0189932 A1 8/2007 Glenn et al.
2007/0199155 A1 8/2007 Thygsen
2009/0056030 A1 3/2009 Bolden
2009/0083908 A1* 4/2009 Fry ..... A47G 9/10 5/636
2009/0249550 A1* 10/2009 Henning ..... A47G 9/0292 5/493
2009/0313795 A1* 12/2009 Hardee ..... A47G 9/0292 24/596.1
2011/0265268 A1* 11/2011 Scarleski ..... A47C 31/105 5/737
2013/0192001 A1* 8/2013 Rensink ..... A47C 31/00 5/691
2014/0157517 A1* 6/2014 Cohen ..... A47G 9/04 5/498
2014/0182060 A1* 7/2014 Mikkelsen ..... A47C 19/025 5/400
2014/0318586 A1* 10/2014 Watson ..... A47C 29/003 135/90
2015/0196147 A1* 7/2015 Jensen ..... A61G 7/015 5/498
2015/0366363 A1* 12/2015 Rohr ..... A47C 21/026 5/613
2017/0245644 A1* 8/2017 Lobel ..... A47C 27/00
2017/0332805 A1* 11/2017 Hagglund ..... A47C 31/105
2018/0027986 A1* 2/2018 Schulte ..... A47C 27/085
2018/0049558 A1* 2/2018 Jurcenko ..... A47G 9/0292
2018/0116432 A1* 5/2018 Sotelo ..... A47G 9/0292
2018/0303256 A1* 10/2018 Sturgeon ..... A47C 21/028
2019/0099018 A1* 4/2019 Holt ..... A47G 9/02
2019/0099020 A1* 4/2019 Stewart ..... A47G 9/0292
2019/0152840 A1* 5/2019 Ferner ..... C09D 7/69
2019/0239503 A1* 8/2019 Kersch ..... A01M 29/34
2019/0254437 A1* 8/2019 Hall ..... A47C 27/002
2020/0397163 A1* 12/2020 Wootten, Jr. ..... A47G 9/0246

OTHER PUBLICATIONS

Cohen et al.; Transmission of health care-associated infections from roommates and prior room occupants: a systematic review; Clinical Epidemiology 2017:9; May 23, 2017; pp. 297-310.

Datta et al.; Environmental Cleaning Intervention and Risk of Acquiring Multidrug-Resistant Organisms From Prior Room Occupants; Arch Intern Med/vol. 171 (No. 6), Mar. 28, 2011; pp. 491-494.

Donskey, MD et al.; Transmission of Clostridium difficile from asymptomatically colonized or infected long-term care facilty residents; Infection Control & Hospital Epidemiology (2018), vol. 39; pp. 909-916.

Hamel, MSc et al.; Exposure to hospital roommates as a risk factor for health care-associated infection; American Journal of Infection Control, vol. 38, No. 3; Apr. 2010; pp. 173-181.

Sexton et al.; Environmental reservoirs of methicillin-resistant *Staphylococcus aureus* in isolation rooms: correlation with patient isolates and implications for hospital hygiene, accepted Jul. 11, 2005; Journal of Hospital Infection (2006) 62; pp. 187-194.

* cited by examiner

BARRIER FOR MATTRESS AND BED DECK

REFERENCE TO RELATED APPLICATION

This application claims priority of U.S. provisional patent application Ser. No. 62/815,662, entitled Barrier for Mattress and Bed Deck, filed Mar. 8, 2019, and hereby incorporates this provisional patent application by reference herein in its entirety.

TECHNICAL FIELD

The apparatus and methods disclosed herein relate to a barrier for a mattress and bed deck. More particularly, the apparatus and methods relate to a mattress and bed deck barrier for an adjustable bed that reduces the exposure of the mattress and bed deck to unsanitary conditions.

BACKGROUND

Healthcare mattresses have integrated covers that enclose the mattress components and are designed to protect the internal mattress components from staining, soiling, bodily fluids, and infectious microorganisms. Mattress covers must be cleaned and disinfected between each patient use to maintain a sanitary environment for the patient. Most integrated covers are inherently difficult to clean and disinfect. They may not be removable, or if so, are not designed for regular removal. Thus, they are intended for cleaning by manual wiping, which requires a substantial amount of time, effort, and consistency to achieve adequate disinfection. Many integrated covers have exposed woven fabric, which further diminishes the potential for effective disinfection. Zippers are usually used to attach integrated mattress covers and if the flap covering the zipper is displaced by bed linens, the zippers will permit bodily fluids to enter the mattress. These covers may also have sewn seams where each stitch hole is a location for bodily fluids to enter the mattress. Finally, integrated covers are prone to failure and fluid leakage due to use of strong chemicals required to achieve disinfection. Failures are difficult to detect before fluid leakage occurs and require time consuming inspection between each patient use. A barrier between the mattress and patient that eliminates all aforementioned issues and provides a highly disinfected and intact resting surface for the patient is desirable.

Mattresses are supported by bed decks. Bed decks come into contact with the same unsanitary conditions as mattresses. For example, waste produced by a patient may flow off the mattress or mattress barrier and accumulate on the supporting bed deck. Under current techniques, the mattress must be manually raised from the bed deck, the bed deck cleaned by hand using a germicidal solution, and the mattress replaced atop the bed deck which can be cumbersome and time consuming. However, hospital workers may neglect to clean the bed deck, or may not fully clean the entire surface of the bed deck. Furthermore, manual cleaning may not be sufficient to eliminate bacteria embedded in the bed deck or to kill fungal spores. Any remaining contamination may be passed from the bed deck to the mattress or bed sheets, from which the contaminants may contact a patient.

BRIEF DESCRIPTION OF THE DRAWINGS

Various embodiments will become better understood with regard to the following description, appended claims and accompanying drawings wherein:

DETAILED DESCRIPTION

Figure 1:
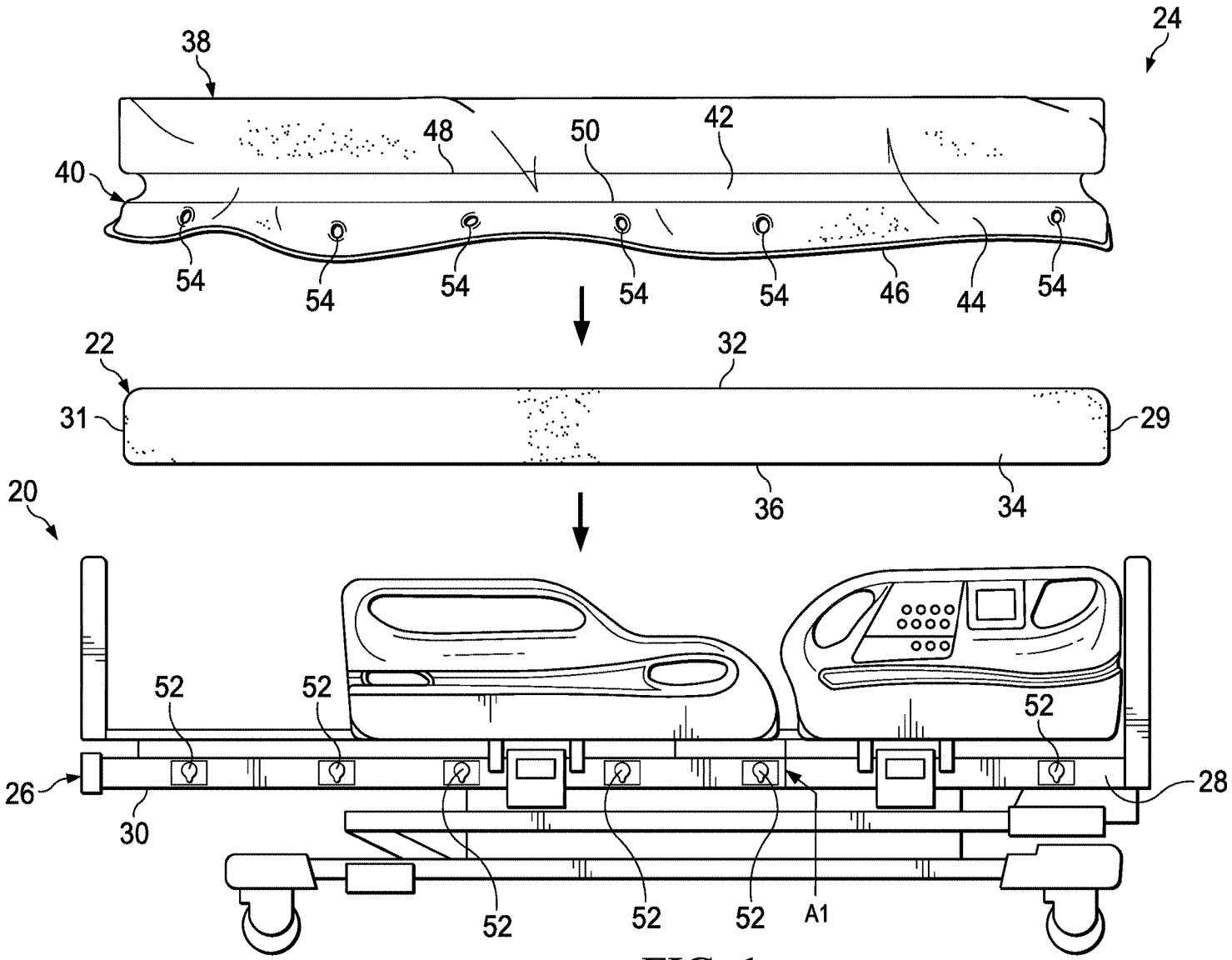
FIG. 1 is an exploded side view depicting a barrier in association with a mattress and an adjustable bed.

Embodiments are hereinafter described in detail in connection with the views and examples of FIGS. 1-9, wherein like numbers indicate the same or corresponding elements throughout the views. An adjustable bed 20, a mattress 22, and a combination mattress/bed deck barrier 24 (hereinafter "the barrier") are generally depicted in FIG. 1. The adjustable bed 20 can include a bed deck 26 that includes a front frame portion 28 and a rear frame portion 30. The front and rear frame portions 28, 30 can support and underlie a head end 29 and a foot end 31, respectively, of the mattress 22. The front frame portion 28 can be pivotable (e.g., vertically) with respect to the rear frame portion 30 about an axis A1 to allow for selective vertical adjustment of the head end 29 of the mattress 22 relative to the foot end 31 (e.g., to facilitate adjustment of a user's head relative to their feet).

The mattress 22 can include a top 32, a plurality of sides 34, and a bottom 36. The barrier 24 can include a mattress cover portion 38 and a skirt 40 that extends beneath the mattress cover portion 38. The skirt 40 can include an upper panel 42 and a lower panel 44. The lower panel 44 can include a lower edge 46. The upper panel 42 can be coupled with the mattress cover portion 38 along a perimeter P1 of the barrier 24 and the lower panel 44 can be coupled with the upper panel 42 along a perimeter P2 of the barrier 24. In one embodiment, the mattress cover portion 38 and the upper panel 42 can be attached together (e.g., sewn, bonded or welded) along a longitudinal seam 48 that defines the perimeter P1, and the upper panel 42 and the lower panel 44 can be attached together (e.g., sewn, bonded or welded) along a longitudinal seam 50 that defines the perimeter P2. In another embodiment, the mattress cover portion 38, the upper panel 42, and the lower panel 44 can be formed together as a one-piece construction such that the perimeter P1 is defined by the transition between the mattress cover portion 38 and the upper panel 42 and the perimeter P2 is defined by the transition between the upper panel 42 and the lower panel 44.

Figure 2:
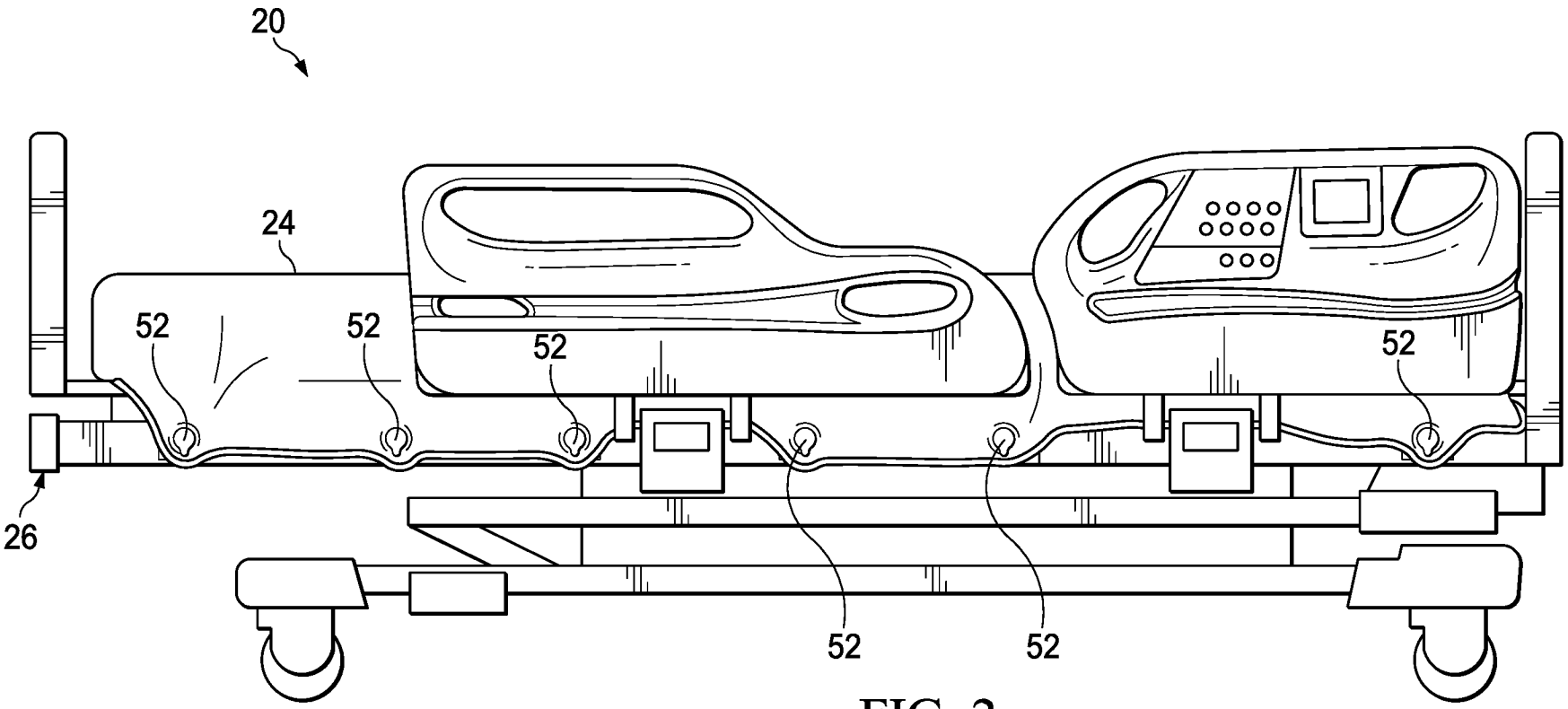
FIG. 2 is an assembled side view depicting the barrier, the mattress, and the adjustable bed of FIG. 1.

Referring now to FIGS. 1 and 2, when the barrier 24 is installed on the mattress 22 (FIG. 2), the mattress cover portion 38 can fit over the top 32 and sides 34 of the mattress 22 and the skirt 40 can extend beneath the mattress 22. The lower panel 44 of the skirt 40 can extend to the bed deck 26 and can be coupled thereto by a plurality of buttons 52 (FIG. 1) that are provided through respective apertures 54 (e.g., FIG. 1) that are disposed along the lower edge 46 of the lower panel 44.

Figure 3:
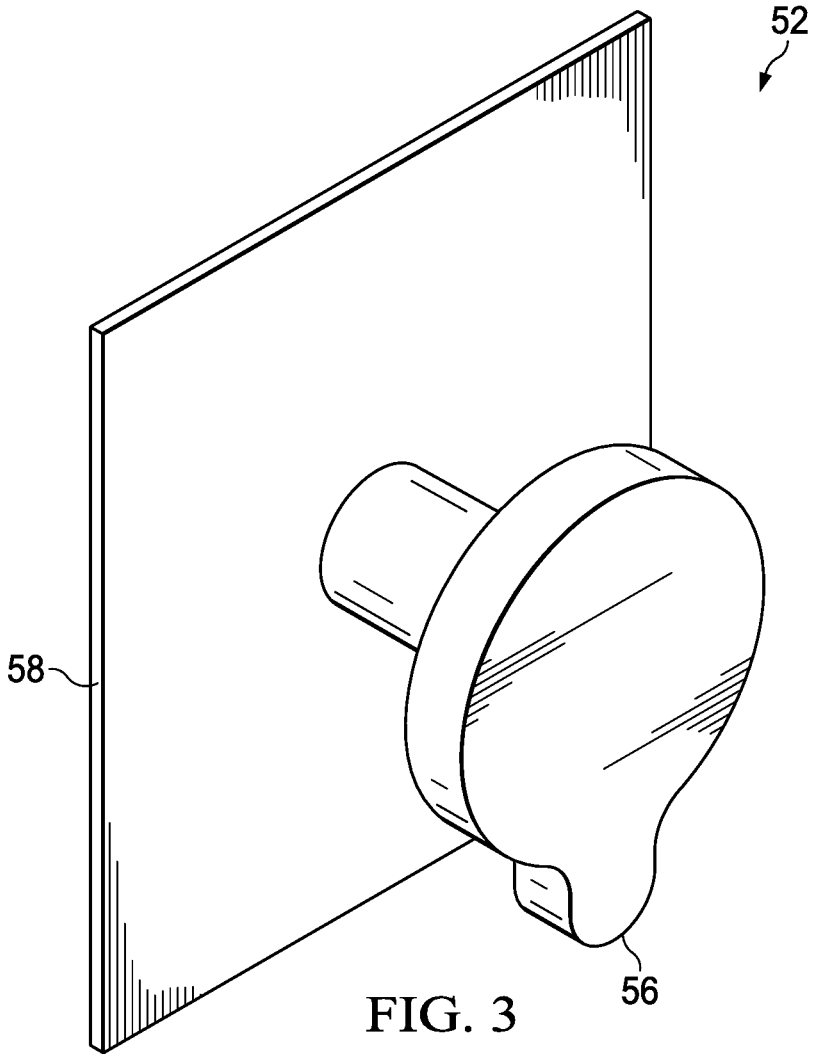
FIG. 3 is an enlarged view depicting a button attached to the adjustable bed of FIG. 1.

Referring now to FIG. 3, one of the buttons 52 is illustrated as a representative example of each of the buttons 52 illustrated in FIGS. 1 and 2. The button 52 can include a tip portion 56 that extends downwardly such that the button 52 has an inverted teardrop shape. When the button 52 is inserted into one of the apertures 54, the tip portion 56 can interface with the lower panel 44 to prevent the lower panel 44 from being inadvertently disconnected from the button 52. The button 52 can be attached to the bed deck 26 by an adhesive layer 58. In one embodiment, the adhesive layer 58 can be a "peel and stick" adhesive layer such that the button 52 can be selectively attached to the bed deck 26 to enable retrofitting of the barrier 24 to an existing adjustable bed. It is to be appreciated that, although a plurality of buttons 52 are described, any of a variety of suitable alternative attachment members are contemplated for selectively attaching the lower panel 44 to the bed deck 26, such as, for example, hooks, snaps, threaded fasteners, magnets, and hook and loop attachments. It is also to be appreciated that the lower panel 44 can have a variety of suitable alternative configurations that facilitate attachment of the lower panel 44 to a bed deck (e.g., 26).

When the barrier 24 is installed over the mattress 22 and attached to the bed deck 26 (e.g., via the buttons 52), as illustrated in FIG. 2, the barrier 24 can extend over each of the mattress 22, the area beneath the mattress 22, and the bed deck 26 to provide a continuous barrier therebetween. When the front frame portion 28 is pivoted (e.g., about axis A1), the barrier 24 can move together with the mattress 22 and the front frame portion 28 to maintain effective coverage over the mattress 22 and the bed deck 26. When the front frame portion 28 is pivoted upwardly, the mattress cover portion 38 can be configured to accommodate any sliding of the foot end 31 of the mattress 22 beyond the rear frame portion 30 to prevent the barrier 24 from being inadvertently dislodged from the mattress 22 and/or the bed deck 26. The barrier 24 therefore can provide more thorough and consistent coverage over a mattress and bed frame than conventional mattress covers (e.g., retail mattress covers that are only configured to cover a mattress).

It is to be appreciated that when the barrier 24 needs to be replaced (e.g., when it is dirty), the skirt 40 can first be detached from the bed deck 26 by manually disengaging the buttons 52 from the apertures 54 and the mattress cover portion 38 can then be slid off of the mattress 22 to completely remove the barrier 24 from the mattress 22. A clean barrier 24 can then be installed by simply slipping the mattress cover portion 38 over the mattress 22 and attaching the skirt 40 to the buttons 52. The construction of the barrier 24 and the buttons 52 cooperate to enable easier and less cumbersome removal and installation than conventional mattress covers.

The barrier 24 can be formed of an impermeable material (e.g., the barrier material) that withstands hydrostatic pressure, can prevent penetration by microorganisms in accordance with medical device barrier standards, and meets biocompatibility requirements for limited contact with human skin. When the barrier 24 is installed on the mattress 22 and attached to the bed deck 26, as illustrated in FIG. 2, the mattress cover portion 38 and the skirt 40 can cooperate to prevent the mattress 22 and the area beneath the mattress 22 from being exposed to any contaminants that may be present on the barrier 24, such as bodily fluids, infectious microorganisms, and dirt. The barrier 24 can accordingly provide a more effective and comprehensive bed barrier solution.

In one embodiment, the barrier material can comprise a multi-directional stretch polyester fabric with welded or sealed seams and/or corners. The barrier material can be coated with a film coating that enhances the disinfecting properties of the barrier 24. In one embodiment, the film coating can be a polyurethane and can incorporate an antimicrobial and/or antifungal agent such as, for example, antimicrobial metal or borophosphosilicate glass carriers containing silver ions. In some embodiments, the film coating can have non-leaching properties. The barrier material can also include flame retardants and thus can be resistant to burning. The barrier material can also be configured to define various multi-directional stretch characteristics that permit the mattress 22 to distribute the patient load as intended without causing the barrier 24 to tear or fail. The barrier material can be configured to provide some level of moisture vapor transfer such that microclimate management features incorporated in some healthcare mattresses are still able to reach the patient.

The barrier material can be configured to withstand conventional healthcare laundering techniques, such as, for example, a process with chemicals and temperatures that provide a 99.9999% reduction (log 6) in common pathogenic microorganisms. As such, the barrier 24 can be repeatedly washed and reused which can be more cost effective and less wasteful than certain conventional mattress covers.

Figure 4:
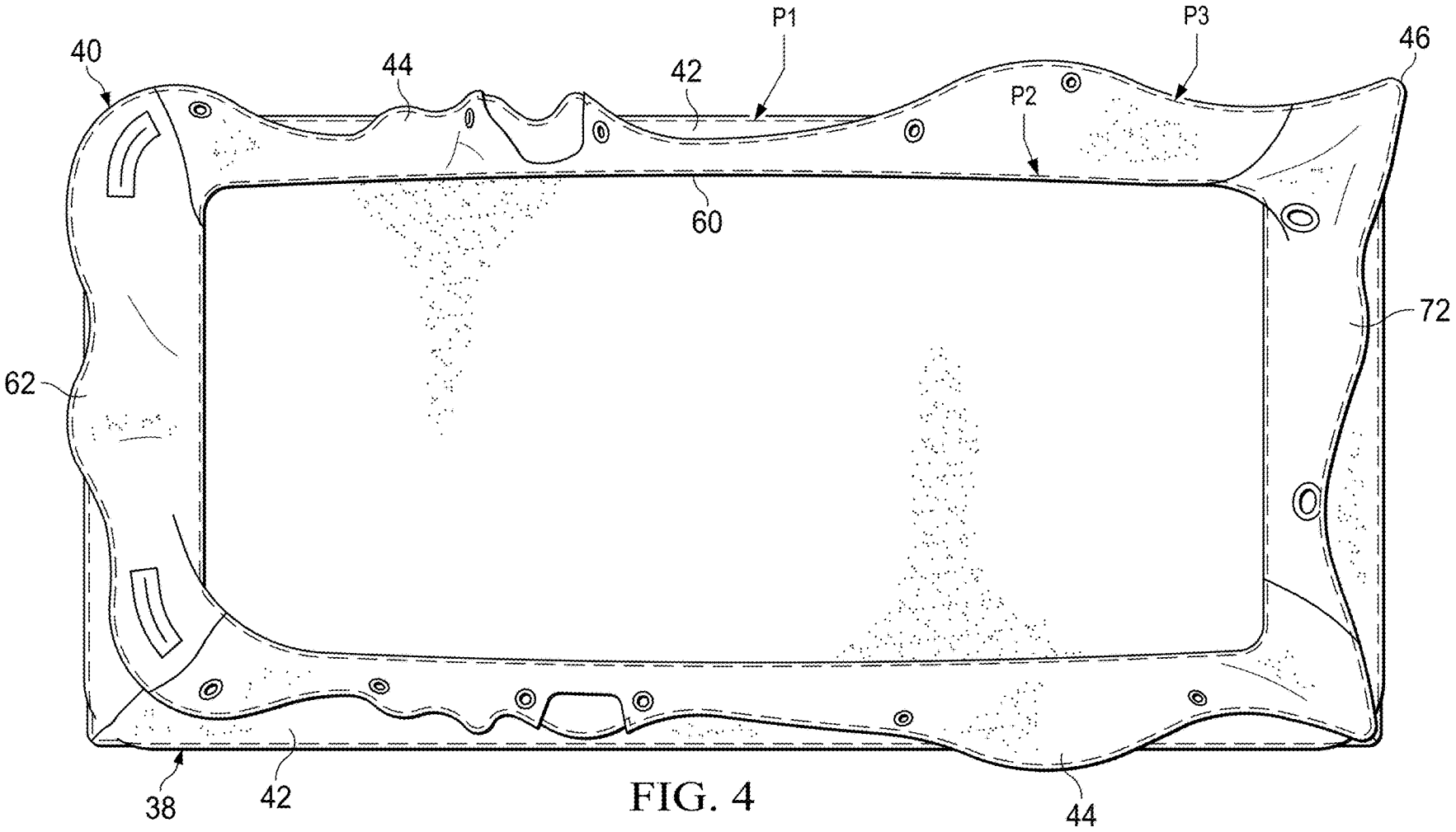
FIG. 4 is a bottom elevational view of the barrier of FIG. 1.

Referring now to FIG. 4, the perimeter P2 that is at least partially defined by the intersection of the upper panel 42 and the lower panel 44 can be smaller than the perimeter P1 that is at least partially defined by the intersection of the mattress cover portion 38 and the upper panel 42. The perimeter P2 can be smaller than a perimeter P3 that is defined by the lower edge 46 of the lower panel 44. As a result, when the barrier 24 is installed on the mattress 22 and bed deck 26, the skirt 40 can be gathered under the mattress 22 while also extending to the bed deck 26. In one embodiment, as illustrated in FIG. 4, the barrier 24 can include an elastic band 60 that is routed along the perimeter P2. The elastic band 60 can facilitate drawing or cinching of the skirt 40 under the mattress 22 such that at least a portion of the skirt 40 is provided between the mattress 22 and the bed deck 26. In another embodiment, the barrier 24 can include a drawstring or other feature that facilitates selective collection (e.g., drawing) of the barrier 24 under the mattress 22.

Figure 5:
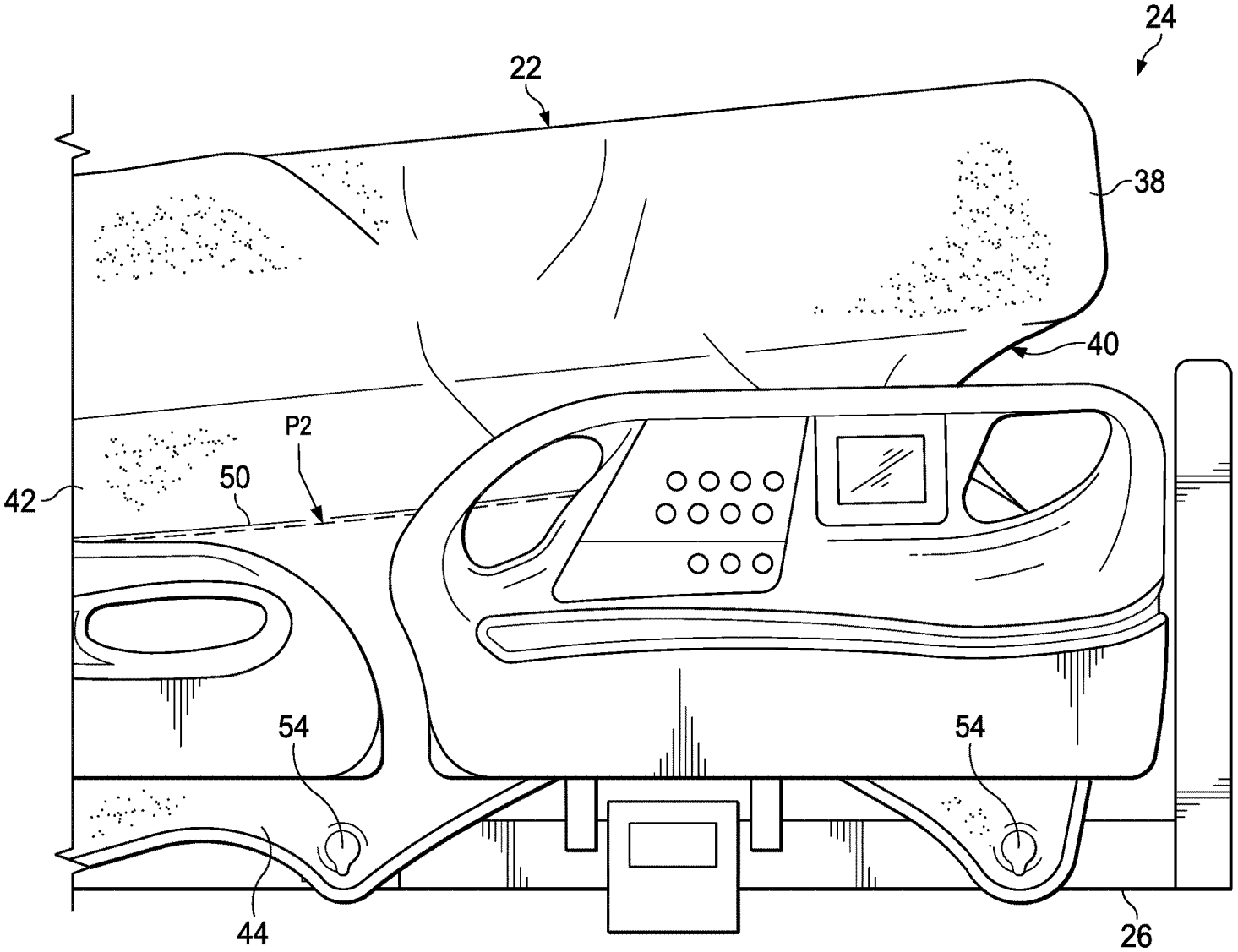
FIG. 5 is an enlarged side view depicting the barrier, the mattress, and the adjustable bed barrier of FIG. 2, but with the mattress shown in a tilted position.

Referring now to FIGS. 2 and 5, the mattress 22 can be selectively tilted relative to the bed deck 26 between a flat position (FIG. 2) and a tilted position (FIG. 5). As illustrated in FIG. 5, when the mattress 22 is in the tilted position, one side of the mattress 22 (e.g., a left side) can be elevated relative to the bed deck 26 which can aid a caregiver in positioning or turning a patient. It is to be appreciated that although FIG. 5 shows only the head end 29 of the mattress 22 elevated, the foot end (e.g., 31) can be additionally or alternatively elevated during tilting of the mattress 22. When the mattress 22 is tilted, the skirt 40 can be laterally expanded to accommodate such tilting while remaining attached to the bed deck 26 to prevent contaminants from being introduced underneath the mattress 22 and along the bed deck 26 during such tilting. It is to be appreciated that the upper panel 42 and the lower panel 44 can include enough excess material to allow the barrier 24 to be gathered under the mattress 22 when flat (as illustrated in FIG. 2), as well as to accommodate tilting of the mattress 22 (as illustrated in FIG. 5).

Figure 6:
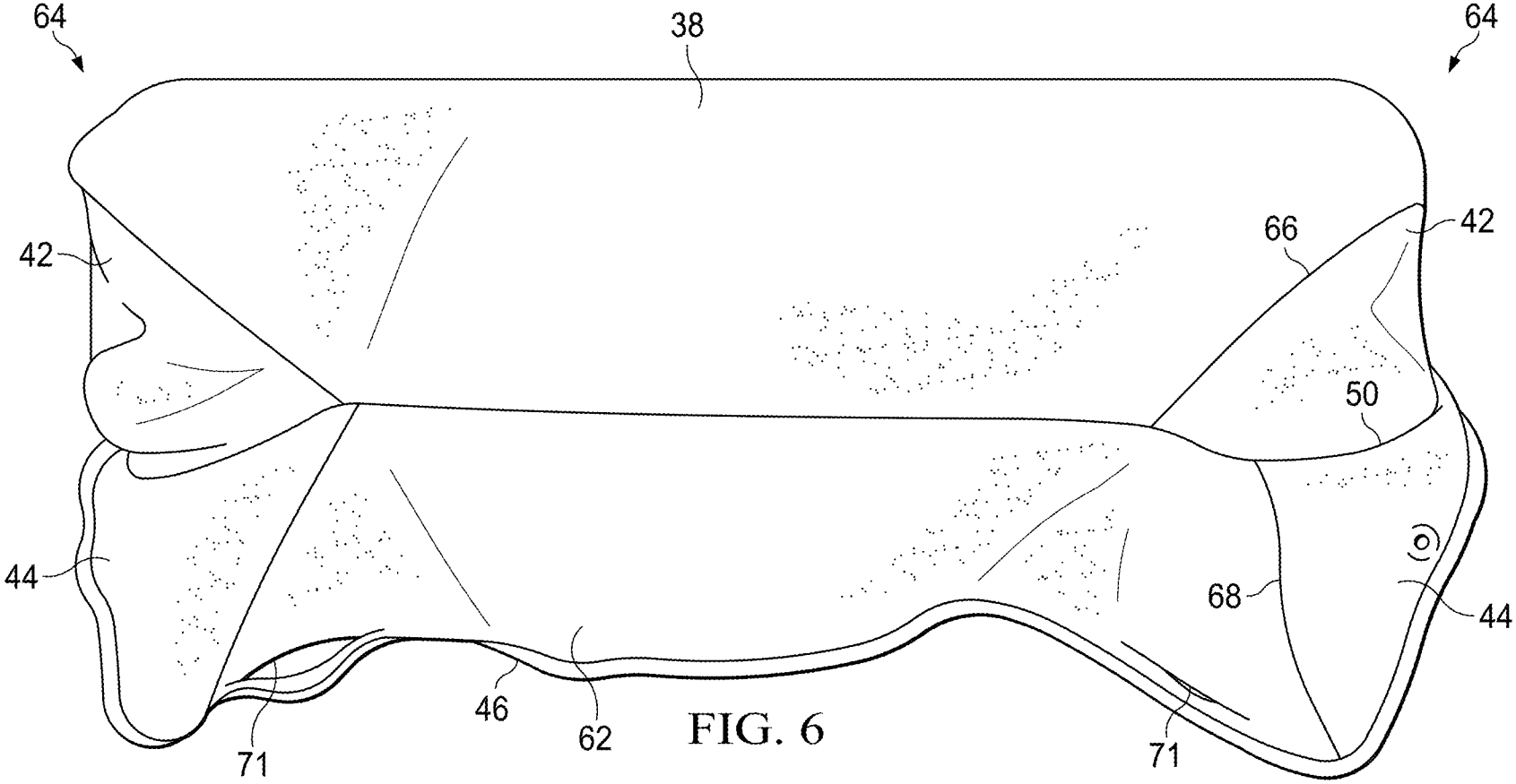
FIG. 6 is a front elevational view of the barrier of FIG. 1.
Figure 7:
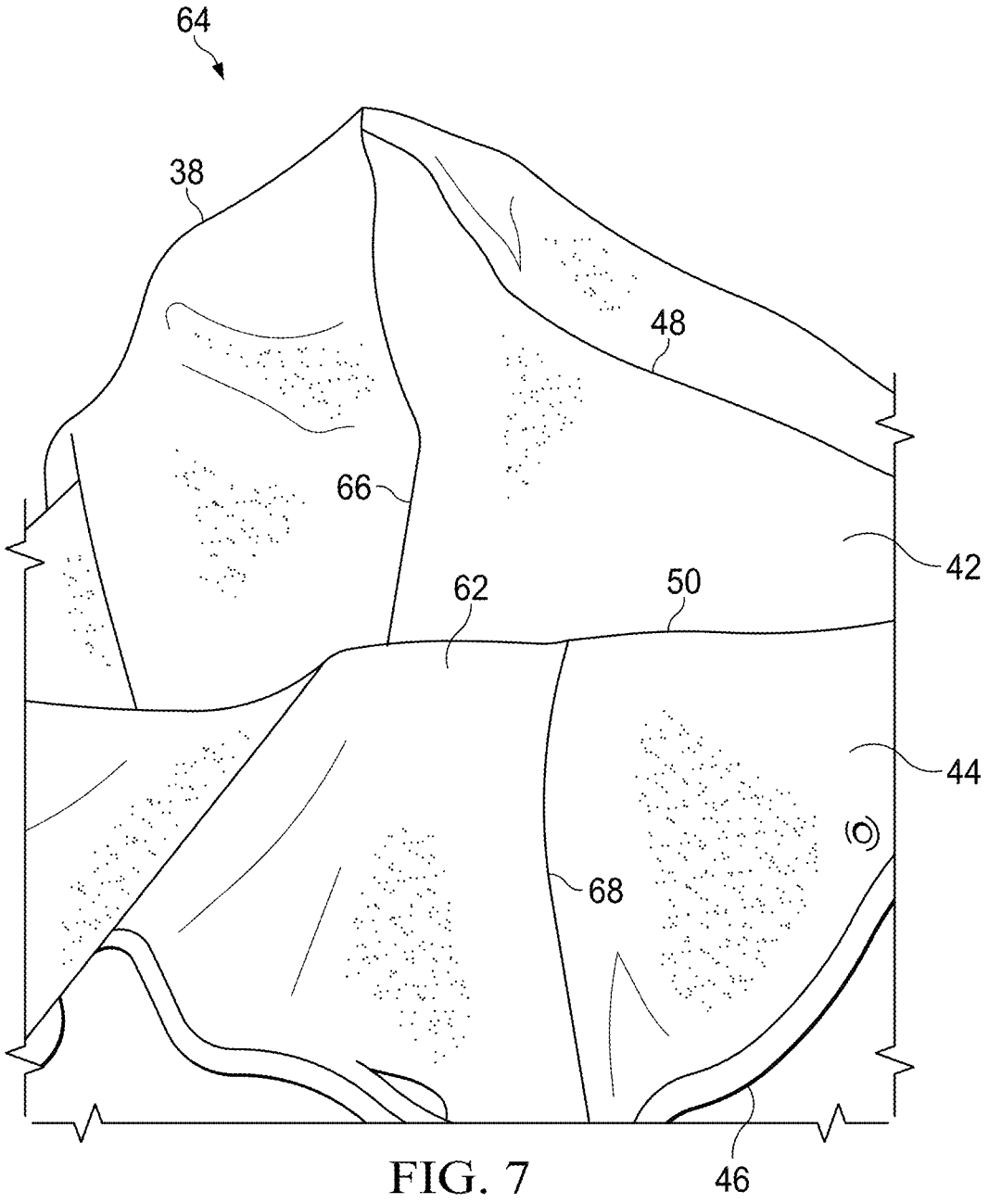
FIG. 7 is an enlarged elevational view of a front corner of the barrier of FIG. 1.

Referring now to FIGS. 6 and 7, the skirt 40 can include a front panel portion 62 that is joined together with the upper and lower panels 42, 44 at front corners 64. One of the front corners 64 is illustrated in FIG. 7 and can be understood to be representative of both of the front corners 64. The upper panel 42 can be coupled with the mattress cover portion 38 along a lateral seam 66 that extends laterally from the longitudinal seam 48 (e.g., from the perimeter P1). The lower panel 44 can be coupled with the front panel portion 62 along a lateral seam 68 that extends laterally from the longitudinal seam 50 (e.g., from the perimeter P2) to the lower edge 46. The lateral seams 66, 68 can be laterally offset from each other along the longitudinal seam 50 (e.g., spaced from each other) such that a portion of the longitudinal seam 50 extends between the lateral seams 66, 68 (e.g., the lateral seams 66, 68 are not collinear). This arrangement of the seams 50, 66, 68 can be stronger and less prone to failure than the conventional X-shaped or T-shaped seams that are commonly found in conventional bed barrier arrangements. The barrier 24 can also include an inlet port 71 that allows for routing of a mattress component or accessory through the barrier 24 (e.g., an air hose when the mattress 22 is inflatable or a strap used to activate a CPR function within the mattress 22).

Figure 8:
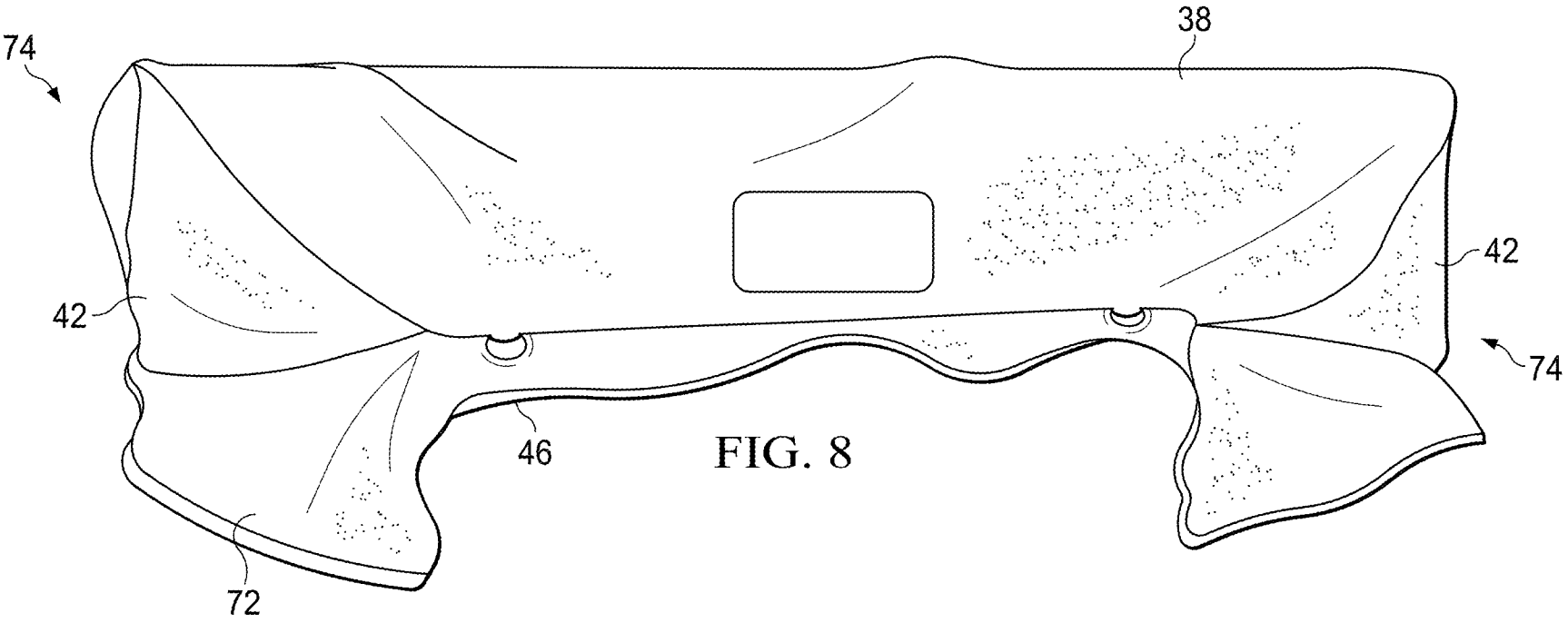
FIG. 8 is a rear elevational view of the barrier of FIG. 1.
Figure 9:
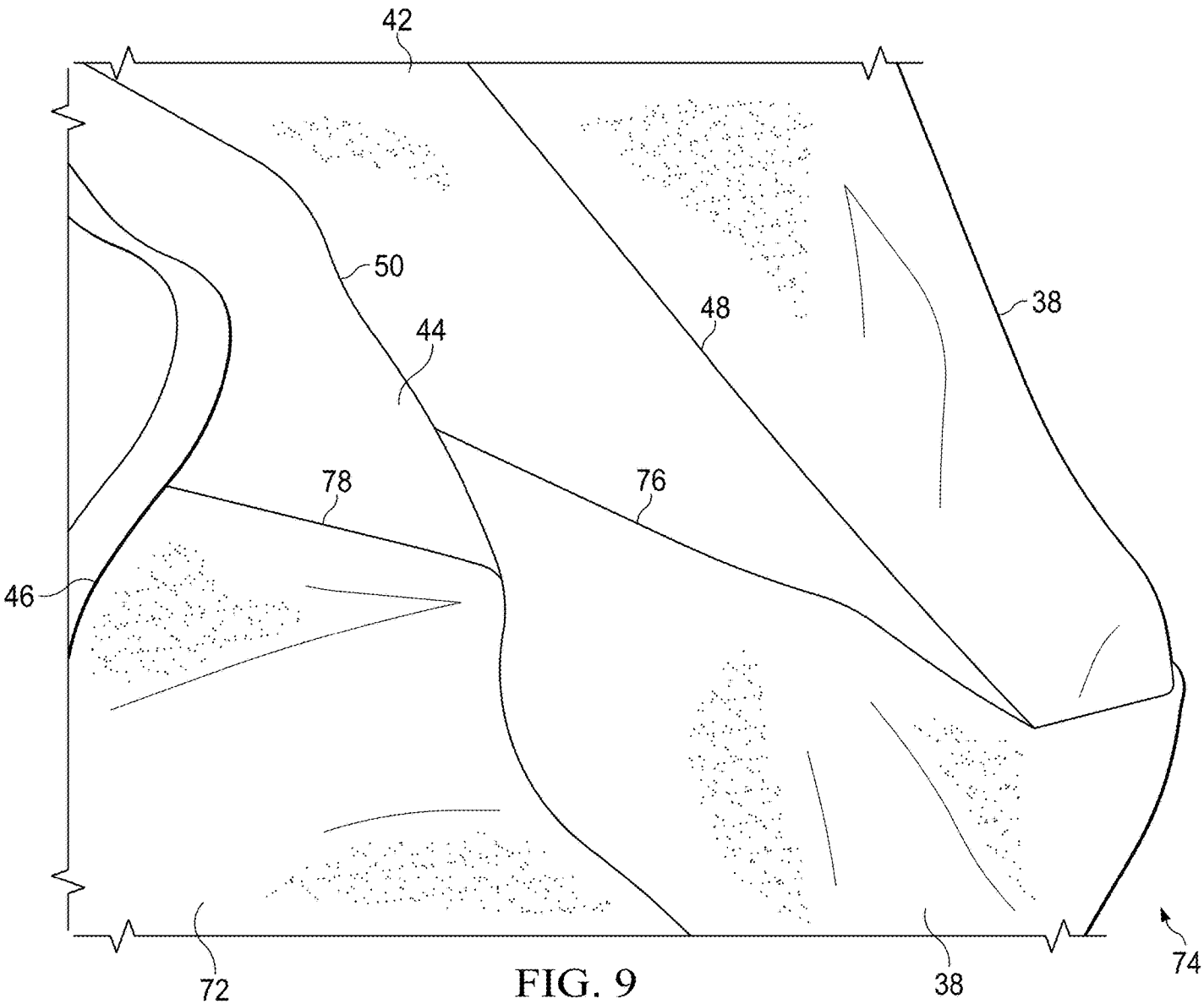
FIG. 9 is an enlarged elevational view of a rear corner of the barrier of FIG. 1.

Referring now to FIGS. 8 and 9, the skirt 40 can include a rear panel portion 72 that is joined together with the upper and lower panels 42, 44 at rear corners 74. One of the rear corners 74 is illustrated in FIG. 9 and can be understood to be representative of both of the rear corners 74. The upper panel 42 can be coupled with the mattress cover portion 38 along a lateral seam 76 that extends laterally from the longitudinal seam 48 (e.g., from the perimeter P1). The lower panel 44 can be coupled with the rear panel portion 72 along a lateral seam 78 that extends laterally from the longitudinal seam 50 (e.g., from the perimeter P2) to the lower edge 46. The lateral seams 76, 78 can be laterally offset from each other along the longitudinal seam 50 (e.g., spaced from each other) such that a portion of the longitudinal seam 50 extends between the lateral seams 76, 78 (e.g., the lateral seams 76, 78 are not collinear). This arrangement of the seams 50, 66, 68 can be stronger and less prone to failure than the conventional X-shaped or T-shaped seams that are commonly found in conventional bed barrier arrangements.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather, it is hereby intended that the scope be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A barrier for a mattress and a bed deck, the barrier comprising:

a mattress cover portion configured to fit over a top and sides of a mattress; and a skirt extending beneath the mattress cover portion and coupled with the mattress cover portion along a first perimeter, the skirt comprising:

an upper panel coupled with the mattress cover portion along the first perimeter;

a lower panel coupled with the upper panel along a second perimeter;

a front panel portion coupled with the mattress cover portion along the second perimeter; and a rear panel portion coupled with the mattress cover portion along the second perimeter, wherein:

the front panel portion and the rear panel portion are each coupled with the lower panel, the lower panel, the front panel portion, and the rear panel portion cooperate to form a lower edge that defines a third perimeter;

the lower panel, the front panel portion, and the rear panel portion cooperate to form a continuous panel that extends along the second perimeter;

the lower panel is configured for selective coupling to a bed deck; and the second perimeter is less than the first perimeter and the third perimeter.

2. The barrier of claim 1 further comprising an elastic band disposed at the second perimeter and configured to gather the skirt at least partially beneath the mattress cover portion.

3. The barrier of claim 1 wherein the lower panel is coupled with the upper panel along a seam that defines the second perimeter.

4. The barrier of claim 1 wherein:

the upper panel is directly attached to the mattress cover portion along a first seam;

the lower panel is directly attached to the front panel portion along a second seam; and the first seam and the second seam are laterally offset from one another along the second perimeter.

5. The barrier of claim 1 wherein the lower panel defines a plurality of apertures configured to receive fasteners to facilitate selective coupling of the lower panel to a bed deck.

6. The barrier of claim 1 wherein the barrier is formed of an impermeable material.

7. The barrier of claim 6 wherein the impermeable material comprises a multi-directional stretch polyester fabric.

8. The barrier of claim 1 wherein the barrier comprises a film coating.

9. The barrier of claim 8 wherein the film coating comprises polyurethane.

10. The barrier of claim 9 wherein the film coating comprises one or more of an antimicrobial agent and an antifungal agent.

11. The barrier of claim 10 wherein the antimicrobial agent comprises borosilicate glass particles doped with silver ions.

12. The barrier of claim 1 wherein:

the upper panel is directly attached to the mattress cover portion along a first seam;

the lower panel is directly attached to the rear panel portion along a second seam; and the first seam and the second seam are laterally offset from one another along the second perimeter.

13. A kit comprising:

a barrier for a mattress and a bed deck, the barrier comprising:

a mattress cover portion configured to fit over a top and sides of a mattress; and a skirt extending beneath the mattress cover portion and coupled with the mattress cover portion along a first perimeter, the skirt comprising:

an upper panel coupled with the mattress cover portion along the first perimeter;

a lower panel coupled with the upper panel along a second perimeter;

a front panel portion coupled the mattress cover portion along the second perimeter; and a rear panel portion coupled with the mattress cover portion along the second perimeter; and a plurality of attachment members configured to facilitate selective attachment of the skirt to a bed deck of a bed deck, wherein:

the front panel portion and the rear panel portion are each coupled with the lower panel, the lower panel, the front panel portion, and the rear panel portion cooperate to form a lower edge that defines a third perimeter;

the lower panel, the front panel portion, and the rear panel portion cooperate to form a continuous panel that extends along the second perimeter;

the lower panel is configured for selective coupling to a bed deck; and the second perimeter is less than the first perimeter and the third perimeter.

14. The kit of claim 13 wherein the plurality of attachment members comprise a plurality of buttons configured for attachment to a bed deck, and the skirt defines a plurality of apertures that are each configured to interface with respective ones of the plurality of buttons to facilitate selective attachment of the skirt to a bed deck.

15. The kit of claim 14 wherein each button of the plurality of buttons comprises an adhesive layer to facilitate attachment of the button to a bed deck.

16. The kit of claim 13 wherein the barrier is formed of an impermeable material.

17. The barrier of claim 16 wherein the barrier comprises a film coating that comprises one or more of an antimicrobial agent and an antifungal agent.

18. A barrier for a mattress and a bed deck, the barrier comprising:

a mattress cover portion configured to fit over a top and sides of a mattress; and a skirt extending beneath the mattress cover portion and coupled with the mattress cover portion along a first perimeter, the skirt comprising:

an upper panel coupled with the mattress cover portion along a first perimeter;

a lower panel coupled with the upper panel along a second perimeter;

a front panel portion coupled with the mattress cover portion along the second perimeter; and wherein:

the lower panel is configured for selective coupling to a bed deck;

the lower panel, the front panel portion, and the rear panel portion cooperate to form a lower edge that defines a third perimeter;

the upper panel is directly attached to the mattress cover along a first seam;

the lower panel is directly attached to the front panel portion along a second seam;

the first seam and the second seam are laterally offset from one another along the second perimeter; and the second perimeter is less than the first perimeter and the third perimeter.

19. The barrier of claim 18 wherein the barrier is formed of an impermeable material.

20. The barrier of claim 19 wherein the barrier comprises a film coating that comprises one or more of an antimicrobial agent and an antifungal agent.

21. The barrier of claim 18 further comprising a rear panel portion coupled with the mattress cover portion along the second perimeter wherein:

the upper panel is directly attached to the mattress cover portion along a first seam;

the lower panel is directly attached to the rear panel portion along a second seam; and the first seam and the second seam are laterally offset from one another along the second perimeter.

* * * * *